US007458157B2

(12) United States Patent
Frauchiger

(10) Patent No.: US 7,458,157 B2
(45) Date of Patent: Dec. 2, 2008

(54) METHOD AND DEVICE FOR FABRICATING A TOOTHING AT A THREE-DIMENSIONAL BODY PRODUCED BY FORMING AND FINE BLANKING

(75) Inventor: Paul Frauchiger, Cincinnati, OH (US)

(73) Assignee: Feintool Intellectual Property AG, Lyss (CH)

( * ) Notice: Subject to any disclaimer, the term of this patent is extended or adjusted under 35 U.S.C. 154(b) by 0 days.

(21) Appl. No.: 11/591,372

(22) Filed: Oct. 31, 2006

(65) Prior Publication Data

US 2008/0052888 A1 Mar. 6, 2008

(30) Foreign Application Priority Data

Sep. 1, 2006 (EP) ..... 06090152.7

(51) Int. Cl.
*B23P 15/14* (2006.01)
*B23F 17/00* (2006.01)

(52) U.S. Cl. ..... 29/893.35; 409/9; 409/37; 409/42; 409/58; 409/60; 72/324; 72/340; 72/352; 72/358; 72/359

(58) Field of Classification Search ..... 29/557–558, 29/893.33, 893.36, 893.35; 72/352, 358, 72/359, 324, 340–341; 409/244, 253, 258, 409/293, 297, 299, 8–9, 33, 37, 42, 45, 49, 409/58–60

See application file for complete search history.

(56) References Cited

U.S. PATENT DOCUMENTS 2,968,998 A * 1/1961 Pracg ..... 409/33
4,275,924 A 6/1981 Lehmann et al.
4,573,739 A 3/1986 Schottker
5,527,126 A * 6/1996 Digel et al. ..... 83/188
5,762,439 A 6/1998 Siner
6,212,930 B1 * 4/2001 Skrabs et al. ..... 72/336
2005/0103083 A1 * 5/2005 Korner et al. ..... 72/355.6
2007/0039163 A1 * 2/2007 Vogel ..... 29/557

FOREIGN PATENT DOCUMENTS

DE 2834492 2/1980

(Continued)

OTHER PUBLICATIONS

Machine Translation of JP-08-141676-A.*

*Primary Examiner*—Erica E Cadugan
(74) *Attorney, Agent, or Firm*—Jordan and Hamburg LLP

(57) ABSTRACT

A method and a tool for fabricating a toothing at a three-dimensional body produced by forming and fine blanking, especially an attachment for car seat components or the like produced out of a flat strip, wherein the flat strip by forming and fine blanking in a tool is formed into a pot-shaped body with inner forms and a substantially evenly curved edge. Afterwards, a toothing is fabricated into the edge radially extending to the inner side of the body. The toothing in the edge of the pot-shaped body is exclusively produced by cutting and/or shaving with a fine blanking die and/or a shaving device, and a burr and/or shaving chips developing during cutting and/or shaving are pressed into a recess in the base of the pot-shaped body allocated to the toothing.

6 Claims, 4 Drawing Sheets

FOREIGN PATENT DOCUMENTS

| | | | |
|---|---|---|---|
| DE | 3227222 | | 5/1984 |
| DE | 3244399 | | 6/1984 |
| DE | 19750184 | | 5/1998 |
| DE | 19801431 | | 7/1999 |
| EP | 987081 | A1 * | 9/1998 |
| EP | 1 297 911 | | 4/2003 |
| JP | 57139432 | | 8/1982 |
| JP | 08 141676 | A * | 6/1996 |
| WO | WO- 2004/094083 | | 11/2004 |

* cited by examiner

METHOD AND DEVICE FOR FABRICATING A TOOTHING AT A THREE-DIMENSIONAL BODY PRODUCED BY FORMING AND FINE BLANKING

BACKGROUND OF THE INVENTION

The invention relates to a method for fabricating a toothing at a three-dimensional body produced by forming and fine blanking, especially an attachment for car seat components or the like produced out of a flat strip, wherein the flat strip is formed by forming and fine blanking in a tool into a pot-shaped body with inner forms in a base of the body, including impressions and/or projections and/or indentations and/or recesses and/or sinks and/or holes and/or pivots and a substantially evenly curved edge. Subsequently, a toothing radially extending to the inner side of the body is fabricated into the edge.

The invention further relates to a device for the fabrication of a toothing at a three-dimensional pot-shaped body produced by forming and fine blanking, especially a hinge attachment for car seat components or the like, with a tool for forming teeth into a substantially evenly curved edge of a pot-shaped body having inner forms in a base thereof, such as, for example, impressions and/or projections and/or indentations and/or recesses and/or sinks and/or holes and/or pivots, wherein the teeth of the toothing radially extend to the inner side of the pot-shaped body, in which the three-dimensional body is fixed between a base plate and a pressure pad.

Conventionally, seat adjustment components, for example, fixed and swivelling hinge parts of hinge attachments, are produced by forming, fine blanking or stamping, with the necessary high dimensional accuracy for their final intended use. These hinge parts for transmitting rotational movements have inner or outer toothings, which are formed as projections in one piece with the respective hinge part (DE 32 44 399 C2, DE 28 34 492 C2, DE 32 27 222 C1).

It is common to produce toothings at hinge attachments by fine blanking (DE 32 44 399 C2, DE 198 01 431 A1). These known hinge attachments all consist of disk-shaped attachment parts. But when the body hinge attachments have a dynamically balanced, i.e., three-dimensional, form, toothings heretofore could not be economically produced by common fine blanking, because the burr developing during fine blanking cannot be removed, even by a downstream second process step due to the three-dimensional transitions in the region of the fine blanking surface. Consequently, inner toothings at three-dimensional hinge attachments are produced by cold forming (see, for example, DE 197 50 184 A1). This, however, is connected with the disadvantage of reduced dimensional accuracy of the teeth, because the tips of the teeth are always rounded. Furthermore, cold forming is associated with the disadvantage that an additional heat treatment, for example, interstage annealing of the cold formed toothing, becomes necessary, which in turn leads to a loss of time and higher production costs.

In view of the current state of the art, it is an object of the invention to provide a method and a device for the fabrication of a toothing at a pot-shaped body produced by forming and fine blanking, in a way that the fine blanking of toothings is economically applicable also in case of dynamically balanced three-dimensional bodies, such as, hinge attachments with simultaneously increasing dimensional accuracy of the toothing, wherein the process safety is increased because of the cessation of the heat treatment and the tool can be designed more compactly.

SUMMARY OF THE INVENTION

This object is solved by a method of the kind discussed above in which a pot-shaped body is created by forming and fine blanking out of a flat strip in a tool, the pot-shaped body having inner forms in a base thereof and including a substantially evenly curved edge. A toothing in the edge radially extending to an inner side of the body is formed therein, the toothing in the edge of the pot-shaped body being exclusively produced by cutting and/or shaving with a fine blanking die and/or a shaving device. In accordance with a feature of the invention, a burr and/or shaving chips developing during the cutting and/or shaving is pressed into an indentation allocated to the toothing.

In accordance with the invention, toothings, for example inner toothings at three-dimensional dynamically balanced bodies, can be produced by fine blanking or shaving with higher dimensional accuracy and economic efficiency.

Of special importance, is that it becomes possible to create a 100% even cut surface without a further process step, because the burr or shaving chips developing during cutting or shaving is pressed into a recess in the base of the pot-shaped body allocated to the toothing.

The teeth of the toothing are filled with material up to their tips, whereby the dimensional accuracy is substantially improved.

In addition to the effect of saving an entire process stage by virtue of cessation of the heat treatment, such factor also leads to the extraordinary advantage that sources of errors in the execution of the process are eliminated and thus the process safety is improved.

The device according to the invention can be integrated into the production process of hinge attachments by fine blanking and stamping as well as forming operations. Because it becomes possible to produce the inner toothing by fine blanking and shaving operations, the tool can be designed more compactly.

Further advantages and details can be learned from the following description with reference to the enclosed drawings.

DETAILED DESCRIPTION OF THE INVENTION

By means of the method according to this invention a three-dimensional pot-shaped body 1 (hinge attachment) with an inner toothing 2 can be formed.

Figure 1:
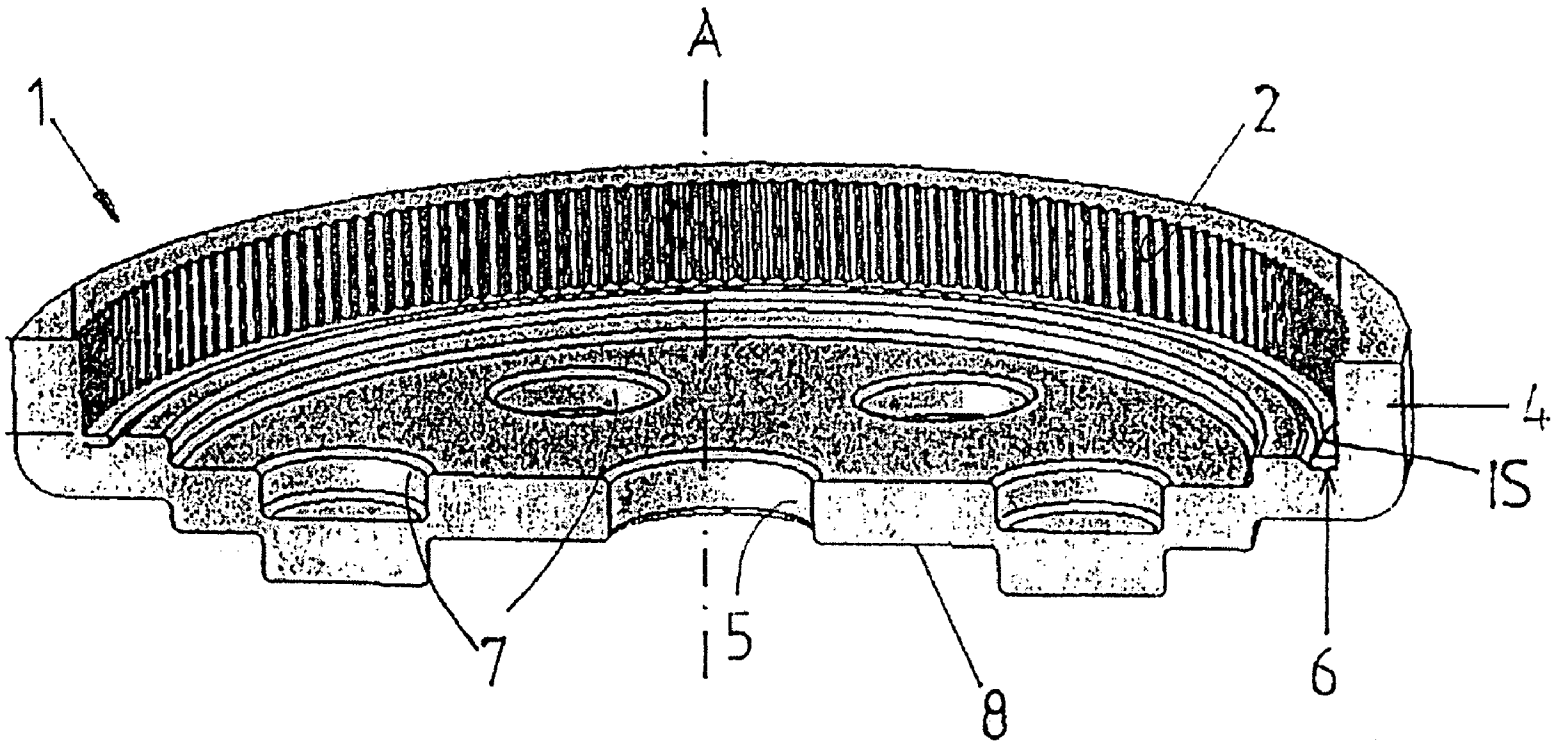
FIG. 1 is a sectional view through a common three-dimensional hinge attachment with inner toothing, which was produced according to the method of the invention.
Figure 2:
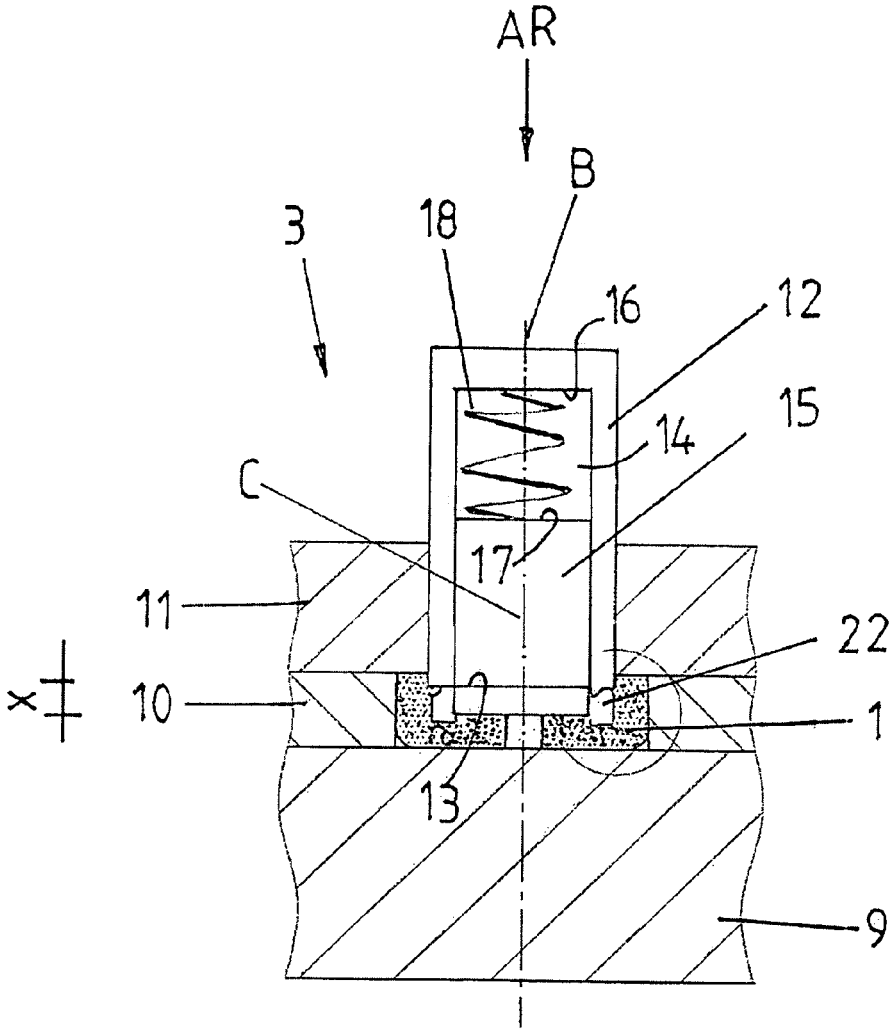
FIG. 2 is a principal diagram of the device according to the invention.

FIG. 2 shows the principal construction of the device 3 according to the invention, by means of which the method according to the invention is executable.

In the finished state, the pot-shaped body 1 has a circular edge 4, a central hole 5 for inserting a hinge axle (not shown) along a hinge axis A, a circular embossed recess 6 adjacent to edge 4 and ejected impressions 7 in the base 8 of body 1, which serve for fixing to the frame of the back of the seat, for example, by welding.

The device 3 according to this invention, as shown in FIG. 2, has a base plate 9, on which the pot-shaped body 1 is fixed. The pot-shaped body 1 is held by a distance plate 10 the height of which corresponds to the height of the body 1. On the circular edge 4 of body 1 lies a pressure pad 11, which firmly fixes body 1 between base plate 9 and pressure pad 11.

The fine blanking die 12 is part of a fine blanking tool (not shown). The working direction of the fine blanking die 12 is denoted with AR.

A hollow space 14 is provided in the end portion 13 of the fine blanking die 12 that extends towards body 1, in which is placed a sliding pilot die 15, the axis C of which lies on the axis B of the fine blanking die 12. This pilot die 15 is pushed to a certain amount X out of the hollow space 14 by a compression spring 18 which is placed between the bottom end 16 of the hollow space 14 and the end 17 of the pilot die 15, extending to the direction away from body 1.

Figure 3:
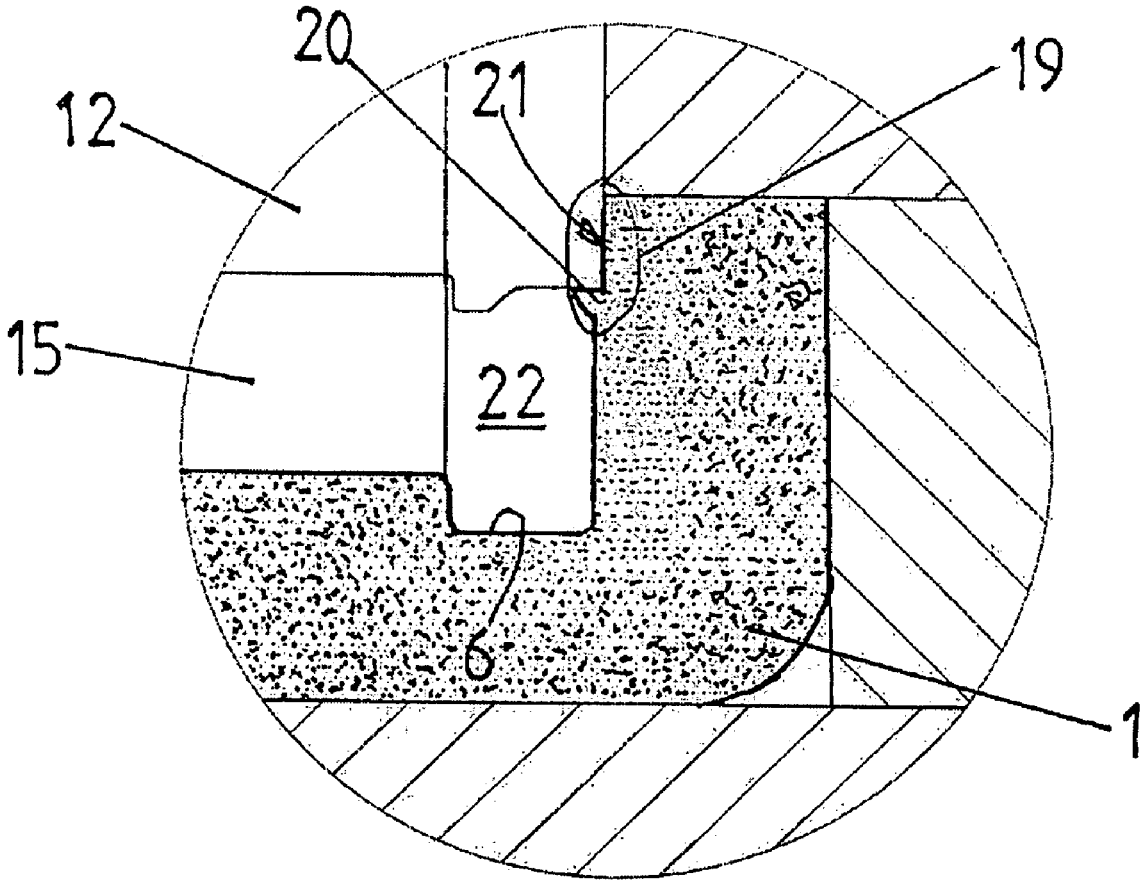
FIG. 3 is a schematic diagram of the fine blanking at the beginning of the method according to the invention.

As soon as the fine blanking die 12 controlled by the pressure pad 11 moves in working direction AR, the fine blanking die 12 starts to cut a toothing 19 at the inner side IS of the circular edge 4 and at its front side shifts a burr 20 on the cutting surface 21 along the inner side IS of the edge 4 (see FIG. 3). The compression spring 18 simultaneously pushes the pilot die 15 to the amount X out of the hollow space 14 of the fine blanking die 12, so that the pilot die 15 contacts the base 8 of body 1 and between the cutting surface 21 on the inner side IS in alignment with indentation 6 creates a groove 22. The burr 20 with the descending movement of the fine blanking die 12 purposefully shifts in this groove 22 downwards into the indentation 6. In the event that a shaving die (not shown here) is used in place of a fine blanking die 12, the groove 22 serves for the purposeful diversion or deflection of possibly developing shaving chips into the indentation 6 and simultaneously prevents shaving chips from getting outside through hole 5.

Figure 4:
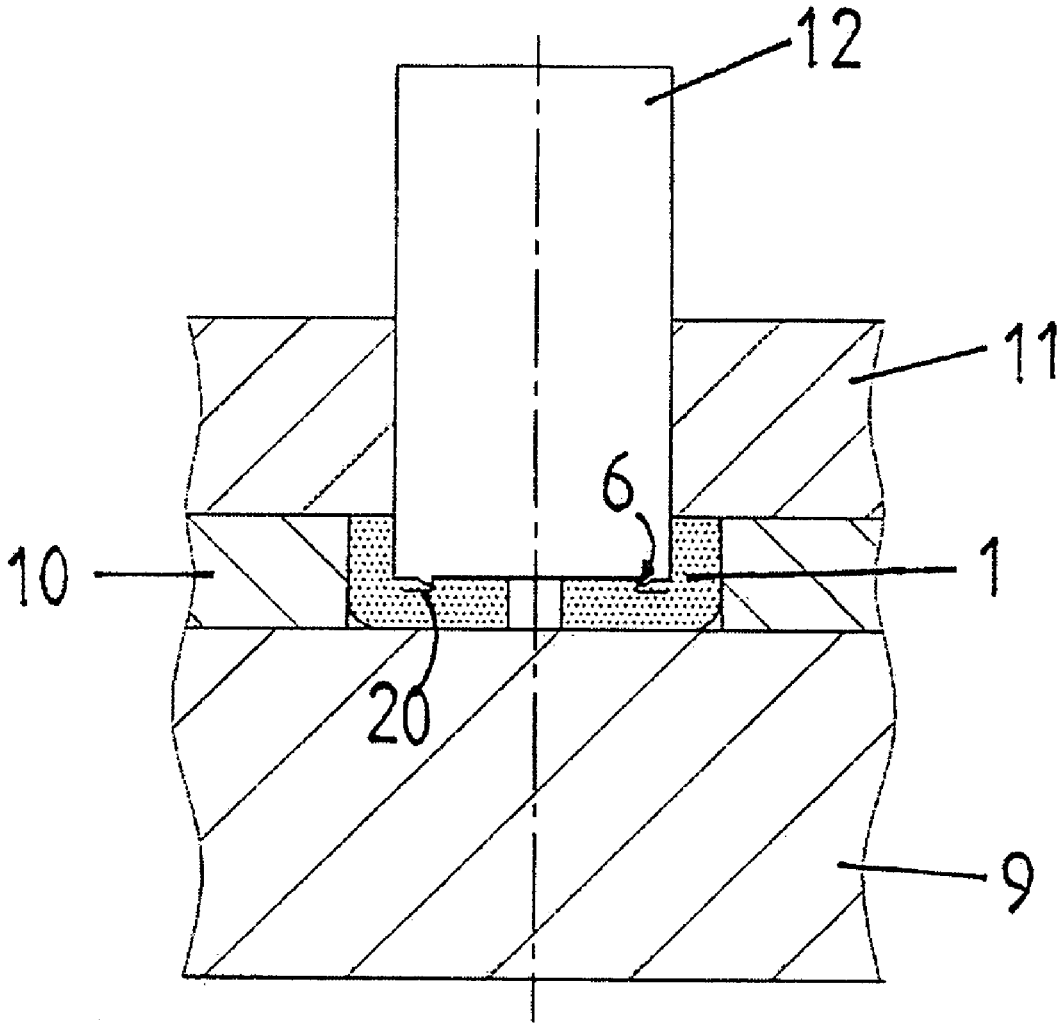
FIG. 4 is a schematic diagram of the fine blanking at the end of the method according to the invention.

FIG. 4 shows the final position of the fine blanking die 12, in which the fine blanking die 12 has contacted the base 8 and has pressed the burr 20 into the indentation 6. The pilot die 15 in this position is pushed back into the hollow space 14 against the compression spring 18. An at least two-staged shaving operation is applied during the process of creating the toothing in edge 4 of the pot-shaped body 1, wherein a shaving die forms the toothing 19 at the inner side IS. The developing shaving chips through groove 22 are led into the indentation and pressed into it by the shaving die as soon as the latter contacts the base 8 of the pot-shaped body 1.

LIST OF DRAWING REFERENCES pot-shaped body (hinge attachment) 1
inner toothing 2
device 3
edge of 1 4
hole in 1 5
recess in 1 6
impression 7
base of 1 8
base plate of 3 9
distance plate of 3 10
pressure pad of 3 11
fine blanking die 12
end of 12 13
hollow space 14
pilot die 15
bottom end of 14 16
opposite end of 12 17
compression spring 18
toothing 19
burr 20
cutting surface 21
groove 22
axis of 1 A
working direction of 12 AR
axis of 12 B
axis of 15 C
amount to which 15 is pushed out of 14 X
inner side of 4 IS

The invention claimed is:

1. A method for fabricating a toothing at a three-dimensional body, comprising:

forming and fine blanking a pot-shaped body out of a flat strip in a tool, said pot-shaped body having inner forms in a base thereof and including a substantially evenly curved edge; and fabricating a toothing in the edge, said toothing radially extending inward with respect to the body, the toothing in the edge of the pot-shaped body being exclusively produced by fine blanking cutting or shaving with a fine blanking die or a shaving device, respectively, and a burr or shaving chips developing during the cutting or shaving, respectively, being pressed into a substantially annular indentation in the base allocated to the toothing.

2. A method according to claim 1, wherein said three-dimensional body is an attachment for a car seat.

3. A method according to claim 1, wherein said inner forms include at least one of impressions, projections, indentations, recesses, sinks, holes and/or pivots.

4. A method according to claim 1, wherein, before the cutting or shaving, the base of the pot-shaped body is fixed by advancement of a fine blanking die pilot die or shaving device pilot die, respectively and the burr or the shaving chips, respectively, are led and pressed into the indentation with defined location as being centrally delimited by the fine blanking die pilot die or shaving device pilot die.

5. A method according to claim 1, wherein the shaving is executed as an at least two-staged operation.

6. A method according to claim 1, wherein the fine blanking cutting is executed in combination with the shaving.

* * * * *